US009239135B2

(12) United States Patent
Goto et al.

(10) Patent No.: US 9,239,135 B2
(45) Date of Patent: Jan. 19, 2016

(54) LED CONNECTOR

(75) Inventors: Kazukiro Goto, Markham (CA); Dragos Luca, Toronto (CA); Andras Gyimes, Toronto (CA); Boguslaw Bombski, Etobicoke (CA)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 711 days.

(21) Appl. No.: 13/557,715

(22) Filed: Jul. 25, 2012

(65) Prior Publication Data

US 2014/0029273 A1 Jan. 30, 2014

(51) Int. Cl.

| | |
|---|---|
| ***F21V 29/00*** | (2015.01) |
| ***F21K 99/00*** | (2010.01) |
| ***F21V 29/74*** | (2015.01) |
| ***F21V 29/80*** | (2015.01) |
| *F21V 23/00* | (2015.01) |
| *F21Y 101/02* | (2006.01) |
| *F21V 29/507* | (2015.01) |
| *F21V 29/83* | (2015.01) |

(52) U.S. Cl.

CPC . *F21K 9/30* (2013.01); *F21V 29/74* (2015.01); *F21V 29/80* (2015.01); *F21V 23/005* (2013.01); *F21V 29/507* (2015.01); *F21V 29/83* (2015.01); *F21Y 2101/02* (2013.01)

(58) Field of Classification Search

CPC ..... F21K 9/30; F21V 29/004; F21V 29/22; F21V 29/2206; F21V 19/003; F21V 23/06; F21V 15/011; F21V 29/002

USPC ..... 362/373, 382

See application file for complete search history.

(56) References Cited

U.S. PATENT DOCUMENTS

| | | | | |
|---|---|---|---|---|
| 6,113,248 | A | 9/2000 | Mistopoulos et al. | |
| 6,429,591 | B1 | 8/2002 | Takamatsu et al. | |
| 7,543,956 | B2 | 6/2009 | Piepgras et al. | |
| 7,638,814 | B2 | 12/2009 | Wall, Jr. et al. | |
| 2007/0001177 | A1 * | 1/2007 | Bruning et al. | 257/79 |
| 2008/0041625 | A1 * | 2/2008 | Cheong et al. | 174/521 |
| 2011/0006684 | A1 | 1/2011 | Hodgson et al. | |
| 2011/0255268 | A1 | 10/2011 | Horn et al. | |
| 2011/0272179 | A1 | 11/2011 | Vasoya | |

* cited by examiner

*Primary Examiner* — William Carter

(57) ABSTRACT

An LED connector has an LED component and a heat sink. The heat sink includes a plurality of conductors having mounting pads. The conductors are formed from an electrically and thermally conductive material. The LED component is mounted to the mounting pads. The conductors define both electrical circuits and thermal heat sinks for the LED connector.

19 Claims, 6 Drawing Sheets

LED CONNECTOR

BACKGROUND OF THE INVENTION

The subject matter herein relates generally to light emitting diode (LED) connectors.

Lighting systems for vehicles are known. The lighting systems provide lighting for different areas of the vehicle. Current lighting systems for vehicles comprise a light source, such as light emitting diodes (LEDs), which directs light into the desired area of the vehicle. For example, the light source may be coupled to a back side of a door panel of a vehicle door and direct light through the door panel onto the door or another part of the vehicle.

High power LEDs typically generate a high amount of heat. Heat dissipation is a problem with known LED systems, particularly with LED connectors that have a small size. The LED connectors typically include a heat sink mounted to the circuit board that holds the LED and the other components of the light engine. The heat is transferred through the circuit board to the heat sink. The circuit board is usually a thermal insulator as opposed to a thermal conductor, making the system inefficient. Traces on the circuit board may dissipate heat from the components, but such traces are relatively thin, narrow and generally not efficient at heat dissipation. Other LED systems oversize the printed circuit board to dissipate the heat without the use of a heat sink.

There is a need for a lighting system that provides efficient heat dissipation for an LED light engine.

BRIEF DESCRIPTION OF THE INVENTION

In one embodiment, an LED connector is provided having an LED component and a heat sink. The heat sink includes a plurality of conductors having mounting pads. The conductors are formed from an electrically and thermally conductive material. The LED component is mounted to the mounting pads. The conductors define both electrical circuits and thermal heat sinks for the LED connector.

In an exemplary embodiment, the LED component is directly coupled to the mounting pads to create an electrical connection between the LED component and the conductors. The conductors may have power contacts extending therefrom defining a power connection for the LED connector. The conductors electrically connect the contacts and the LED component. The conductors may have heat dissipating fins on the second side that are exposed to air.

Optionally, the LED connector may include an over molded body encasing portions of the conductors manufactured from a dielectric material. The body may have windows exposing the conductors to air. The conductors may be separated by gaps and the dielectric body may at least partially fill the gaps between the conductors. The conductors may have inner surfaces extending between the first and second sides that face each other across gaps. The conductors may have removable bridges spanning across the gaps that hold relative positions of the conductors. The dielectric body may at least partially fill the gaps and have windows exposing the bridges to allow for removal of the bridges to electrically separate the conductors.

In another embodiment, an LED connector is provided having a heat sink having a first side and a second side. The heat sink includes a plurality of discrete conductors separated by gaps. The conductors have mounting pads at the first side and fins at the second side. An LED component is mechanically and electrically connected to the mounting pads. The conductors create electrical circuits to power the LED component. The conductors defining direct thermal paths to dissipate heat from the LED component.

In a further embodiment, an LED connector is provided having a heat sink having a first side and a second side. The heat sink has a plurality of discrete conductors separated by gaps. The conductors have mounting pads at the first side. An over-molded dielectric body is molded over the heat sink. The body at least partially fills the gaps to hold the relative positions of the conductors. An LED component is mechanically and electrically connected to the mounting pads. The conductors create electrical circuits to power the LED component. The conductors define a heat sink to dissipate heat from the LED component.

DETAILED DESCRIPTION OF THE INVENTION

Figure 1:
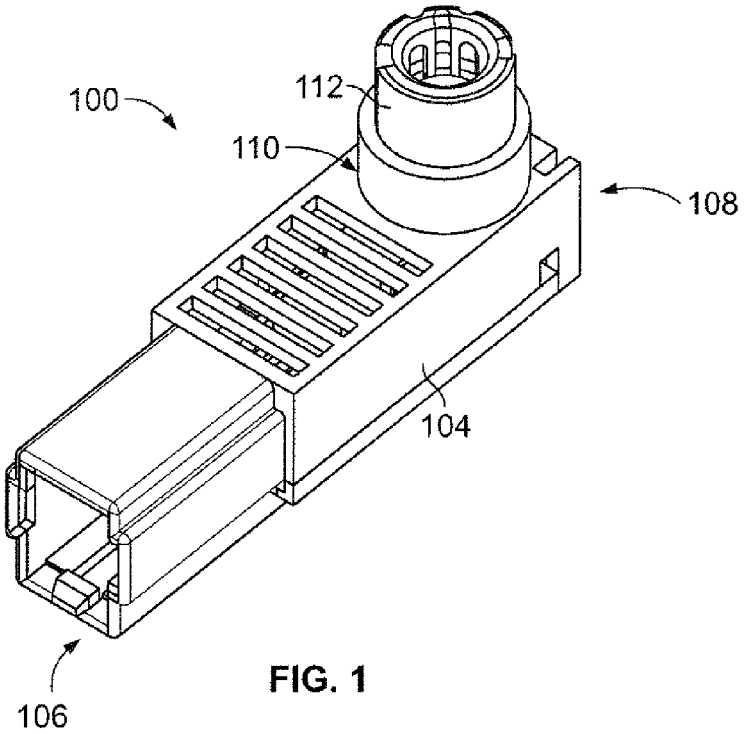
FIG. 1 illustrates an LED connector formed in accordance with an exemplary embodiment.

FIG. 1 illustrates an LED connector 100 formed in accordance with an exemplary embodiment. The LED connector 100 includes an LED light engine 102 (shown in FIG. 2) held in a housing 104. The LED light engine 102 generates and emits light. The housing 104 holds the LED light engine 102. The housing 104 has a mating end 106 and a component end 108. The LED light engine 102 is provided at the component end 108. The mating end 106 is configured to be coupled to a power connector such as a power plug (now shown).

In an exemplary embodiment, the housing 104 has a light port 110 through which the light is emitted. In the illustrated embodiment, a light pipe coupler 112 extends from the housing 104 at the light port 110. The light pipe coupler 112 is configured to receive a light pipe therein. The light pipe then directs the light emitted from the light port 110 to an area remote from the LED connector 100. In alternative embodiments, other components may be provided at the light port 110 for directing light therefrom. For example, a lens may be coupled to the housing 104 to direct light from the LED connector 100.

The LED connector 100 may have a high output of light therefrom. For example, a high power LED may be utilized with the LED connector 100. The LED connector 100 has a compact design to allow use in small spaces. The LED connector 100 may have use in various applications, including automotive applications. The LED connector 100 may be used for interior or ambient lighting within a vehicle. The LED connector 100 may be used for lighting an instrument panel, a door, a footwell, a ceiling, under a seat, in a trunk, in a map pocket, or in other locations of a vehicle. The LED connector 100 may be used in applications other than automotive applications.

Figure 2:
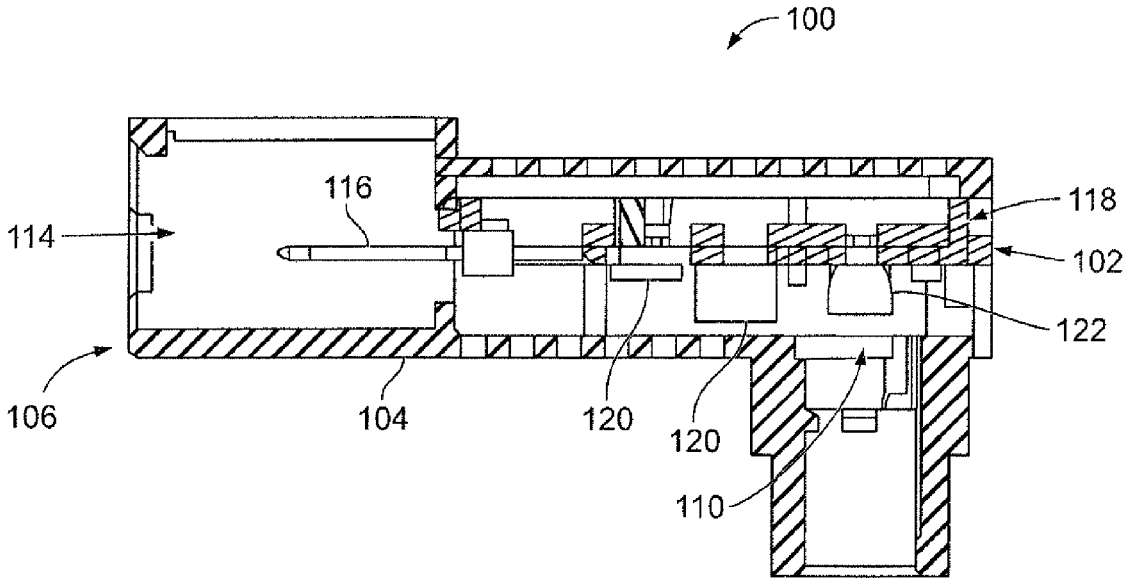
FIG. 2 is a cross-sectional view of the LED connector.

FIG. 2 is a cross-sectional view of the LED connector 100. The LED light engine 102 is illustrated in FIG. 2. The housing 104 surrounds and supports the LED light engine 102. At the mating end 106, a cavity 114 is defined that receives the power plug therein. Contacts such as power contacts 116 of the LED light engine 102 extend into the cavity 114 for mating with the power plug. The power contacts 116 define a power connection for the LED connector 100. The housing 104 includes air vents along the top, bottom, and/or sides of the housing 104 to allow air flow within the interior of the housing 104 for cooling the LED light engine 102.

The LED light engine 102 includes a substrate 118 and a plurality of electrical components 120 mounted to the substrate 118. The power contacts 116 extend from the substrate 118. One of the electrical components 120 is an LED component 122. The LED component 122 emits light therefrom. The LED component 122 is generally aligned with the light port 110 to direct light into the light port 110. Other electrical components 120 control the power supply to the LED component 122. In an exemplary embodiment, the substrate 118 defines both the electrical circuits of the LED light engine 102 and a thermal heat sink for the LED light engine 102.

Figure 3:
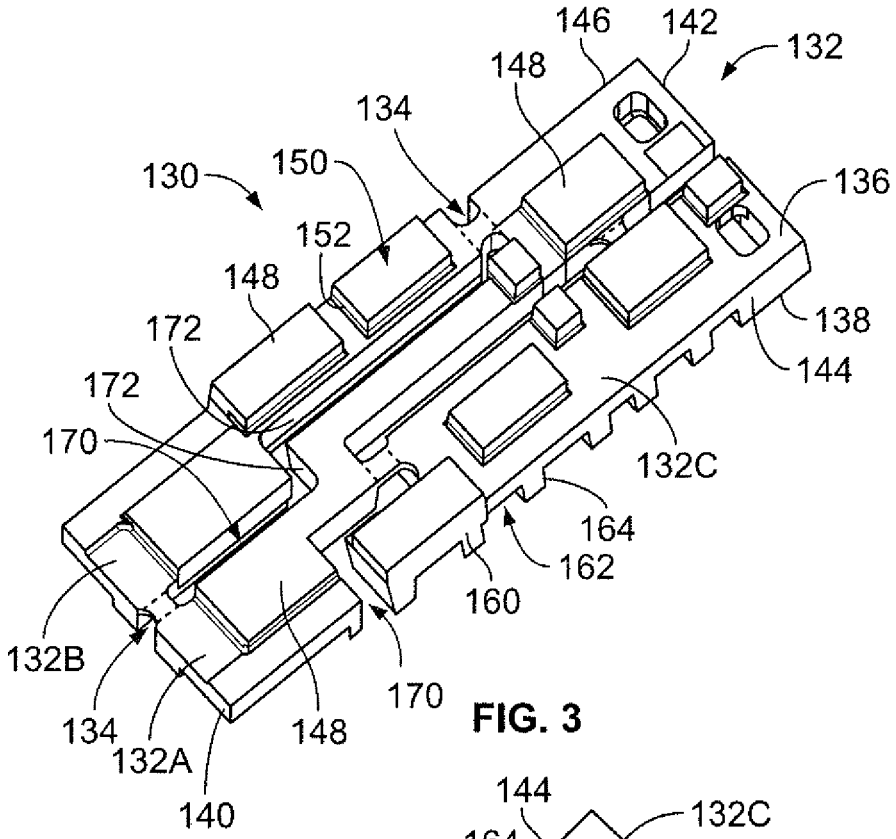
FIG. 3 is a bottom perspective view of a heat sink for an LED light engine of the LED connector.
Figure 4:
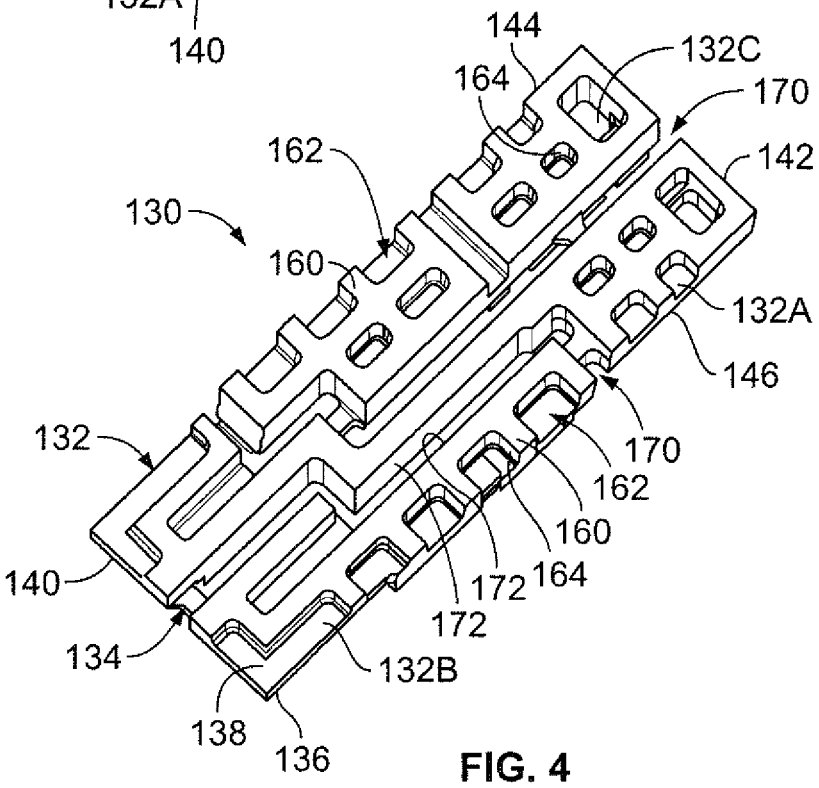
FIG. 4 is a top perspective view of the heat sink shown in FIG. 3.

FIG. 3 is a bottom perspective view of a heat sink 130 for the LED light engine 102. FIG. 4 is a top perspective view of the heat sink 130. In an exemplary embodiment, the heat sink 130 is manufactured as a leadframe and may be referred to hereinafter as leadframe 130. The leadframe 130 defines a portion of the substrate 118 (shown in FIG. 2). The leadframe 130 is manufactured from a material that is electrically and thermally conductive. For example, the leadframe 130 may be manufactured from a metal material, a conductive epoxy, a conductive carbon based structure, such as carbon nanotubes, and the like. The leadframe 130 may be manufactured from zinc, copper, aluminum, or another type of metal. The leadframe 130 defines both the electrical circuits of the LED light engine 102 and the thermal heat sink for the LED light engine 102 and other electrical components 120. In an exemplary embodiment, the leadframe 130 is molded to define the various electrical and thermal features of the leadframe 130. The leadframe 130 may be molded from a metal material, such as by a casting process by casting metal in a mold or die. The leadframe 130 may be molded from a metallic material, such as by injection molding using a conductive resin having metallic particles therein in a mold or form. The leadframe 130 may be metal injection molded. Molding the leadframe 130 allows for varying heights or thicknesses across the leadframe 130. In other alternative embodiments, the leadframe 130 may be manufactured by coining, by machining or by other processes.

The leadframe 130 includes a plurality of conductors 132. The conductors 132 define the electrical circuits of the LED light engine 102. The conductors 132 define a thermal heat sink for the LED light engine 102. The conductors 132 are initially held together as part of a common leadframe by bridges 134. The bridges 134 are formed integral with the conductors 132. The bridges 134 are formed during the molding or machining process to hold the relative positions of the conductors 132. The bridges 134 are removed at a later step of manufacture of the LED light engine 102 to electrically separate the conductors 132 from one another. The bridges 134 function as carriers for the conductors 132 to hold the conductors 132 together as a single unit during manufacture of the LED light engine 102. Optionally, the bridges 134 may be thinner than the conductors 132. The bridges 134 may be removed by stamping, cutting, drilling or other processes to remove the material defining the bridges 134. In an exemplary embodiment, the bridges 134 are internal of the leadframe 130 between the conductors 132. In alternative embodiments, the bridges 134 may additionally or alternatively be external of the leadframe 130 between the conductors 132.

The leadframe 130 has a first side 136 and a second side 138 opposite the first side 136. The first and second sides 136, 138 are the main sides of the leadframe 130 defining the greatest area of the leadframe 130. Edges 140, 142, 144, 146 extend between the first and second sides 136, 138 along the length and width of the leadframe 130. In the illustrated embodiment, the leadframe 130 is generally rectangular in shape; however other shapes are possible in alternative embodiments. The edges 140, 142 define front and rear edges 140, 142, respectively. The conductors 132 generally extend lengthwise between the front and rear edges 140, 142.

In an exemplary embodiment, the conductors 132 have mounting pads 148 on the first side 136. The mounting pads 148 are integral with the conductors 132, such as formed during a common molding process. The mounting pads 148 receive the electrical components 120 (shown in FIG. 2) and allow the electrical components 120 to be directly coupled to the conductors 132. For example, the electrical components 120 may be soldered to the mounting pads 148. Optionally, the mounting pads 148 may be plated to enhance the soldering to the mounting pads 148. For example, the conductors 132 may be manufactured from a zinc diecast material that may be plated with a tin layer over a nickel barrier layer. Optionally, a copper layer may be applied to the zinc diecast base prior to the nickel barrier layer. In an exemplary embodiment, the mounting pads 148 are elevated beyond the main surface defining the first side 136. The mounting pads 148 have a mounting surface 150 and sidewalls 152 extending between the mounting surface 150 and the first side 136.

The heat sink 130 is used to dissipate heat from the electrical components 120. The heat sink 130 is also electrically conductive and defines the electrical path of the circuits of the LED light engine 102. The heat sink 130 includes a plurality of heat dissipating fins 160 on the second side 138. The heat dissipating fins 160 extend from the second side 138 to define air pockets 162. The heat dissipating fins 160 may have any size or shape. The heat dissipating fins 160 may be elongated. The heat dissipating fins 160 may be rounded into a pin-shape. The heat dissipating fins 160 may meander along the leadframe 130. The air pockets 162 are defined by fin walls 164. The fin walls 164 increase the surface area of the heat sink 130 that is exposed to air or another cooling fluid for dissipating heat from the heat sink 130. The air pockets 162 are formed during manufacture (e.g., molding, machining, etc.) of the heat sink 130. The molding process used to form the leadframe 130 allows design flexibility to create a large number of, and efficient placement of, the heat dissipating fins 160 and the air pockets 162, such as compared to conductors that are stamped and formed. The size, shape and positioning of the air pockets 162 and heat dissipating fins 160 may vary depending on the application and are designed to provide efficient heat dissipation for the heat sink 130.

Having the heat sink 130 extending entirely between the first side 136 and the second side 138 allows the electrical components 120 to be directly mounted to the structure that provides the heat dissipation for the LED light engine 102. The conductors 132 are exposed both at the first side 136, for directly engaging the electrical components 120, and at the second side 138, for exposure to air or other cooling fluid for heat dissipation. Allowing the heat sink 130 to operate as the electrical circuits for the LED light engine 102 eliminates the need for a circuit board or other component between the electrical components 120 and the heat dissipating fins 160.

The conductors 132 are separated from one another by gaps 170. The bridges 134 initially extend across the gaps 170 to hold the conductors 132 relative to one another, however the bridges 134 are later removed so that the gaps 170 provide electrical isolation between the conductors 132. The gaps 170 extend entirely through the leadframe 130 between the first side 136 and the second side 138. The gaps 170 are interior of the leadframe 130, extending between the edges 140, 142, 144, 146. Some of the gaps 170 may extend to the edges 140, 142, 144, 146. At the gaps 170, the conductors 132 have inner surfaces 172 extending between the first and second sides 136, 138. The inner surfaces 172 extend entirely between the first and second sides 136, 138 making the conductors 132 have a height that is equivalent to the height of the substrate 118. The inner surfaces 172 face each other across the gaps 170. In an exemplary embodiment, when the LED light engine 102 is being manufactured, the conductors 132 are over molded with dielectric material to at least partially fill in the gaps 170. The molding process used to form the leadframe 130 allows design flexibility to create a relatively thick slug of metal or metallic structure for efficiently dissipating heat, such as compared to conductors that are stamped and formed and are limited to the thickness of the stock metal used as the blank that is stamped and formed.

Figure 5:
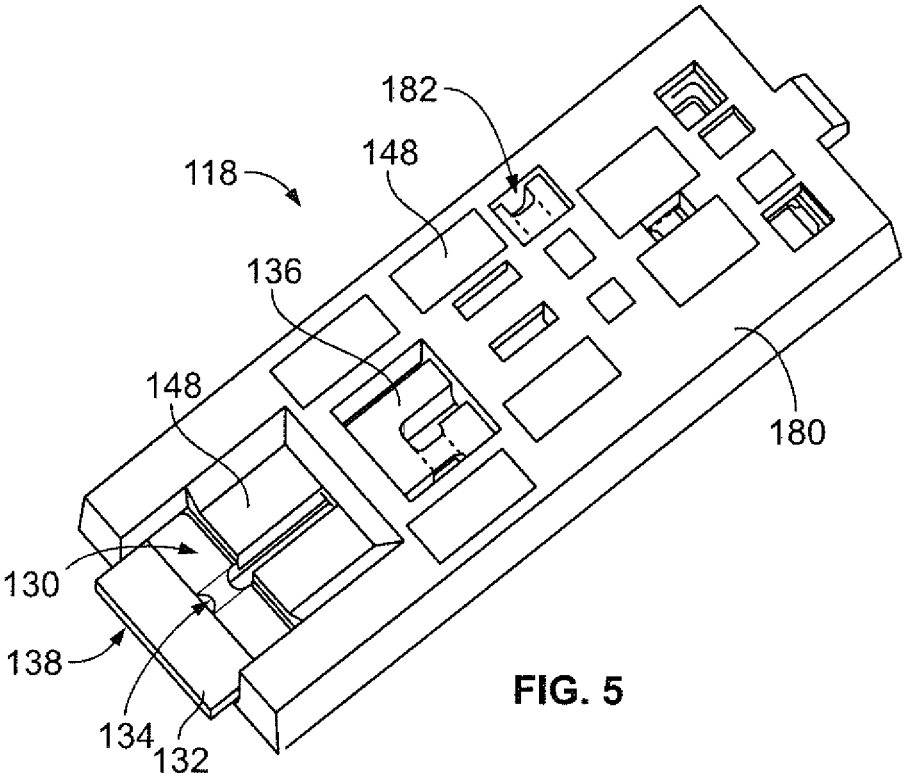
FIG. 5 illustrates a substrate of the LED light engine.

FIG. 5 illustrates the substrate 118. The substrate 118 includes a dielectric body 180 applied directly to the leadframe 130. In an exemplary embodiment, the dielectric body 180 is an over-molded body over the leadframe 130 (shown in FIGS. 3 and 4) to define an over molded dielectric body 180. Alternatively, the dielectric body 180 may be applied in other ways, such as heat staking to the conductors 132, snap-fitting to the conductors 132, gluing or adhering in place, and the like. The conductors 132 may be insert into the dielectric body 180 and secured therein in other alternative embodiments.

The dielectric body 180 may be manufactured from any dielectric material, such as a plastic material. The dielectric body 180 is used to support the conductors 132. Once the dielectric body 180 is over molded, windows 182 are provided through the dielectric body 180. The windows 182 expose the bridges 134 so that the bridges 134 may be removed to electrically separate the conductors 132. In some embodiments, the bridges 134 may be positioned along an exterior edge 140, 142, 144, 146 and exposed exterior of the dielectric body 180 for removal after the dielectric body 180 is formed. The windows 182 expose the conductors 132 to air which may help with heat dissipation from the conductors 132. The dielectric body 180 may at least partially fill the gaps 170 (shown in FIGS. 3 and 4).

In an exemplary embodiment, the first side 136 is covered by the dielectric body 180. The mounting pads 148 extend through the dielectric body 180 and are exposed beyond or through the dielectric body 180. The dielectric body 180 does not entirely cover the second side 138, but rather the heat dissipating fins 160 (shown in FIG. 4) are exposed beyond or through the substrate 118 to allow air flow into the air pockets 162 (shown in FIG. 4) and to aid in heat dissipation. In an exemplary embodiment, the dielectric body 180 engages the inner surfaces 172 of the conductors 132. The dielectric body 180 engages the sidewalls 152 (shown in FIG. 3) of the mounting pads 148.

In an exemplary embodiment, the leadframe 130 fills a majority of the volume of the substrate 118. The leadframe 130 has a greater volume than the dielectric body 180. Having large conductors with a large volume of metal material to fill the substrate 118 helps in conveying a high current (as compared to thin traces of a PCB) and to help in dissipating heat (as compared to thin traces of a PCB or to the dielectric material of the PCB dissipating heat). Having the leadframe 130 operate as the heat sink provides less thermal interfaces between the heat generating components and the heat dissipating fins 160 as compared to conventional devices. For example, conventional devices have a PCB mounted to a heat sink having one thermal interface between the heat generating components and the PCB and another thermal interface between the PCB and a conventional heat sink. The heat in such conventional devices passes through the PCB to the heat sink, which is a less efficient way to transfer heat than using the leadframe 130.

Figure 6:
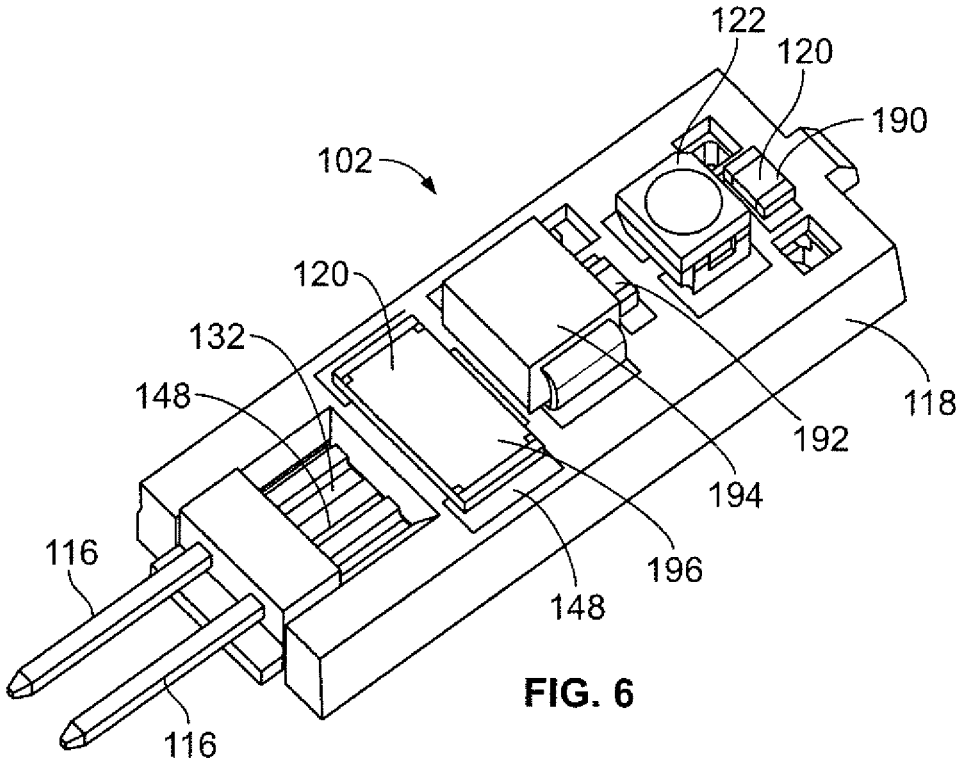
FIG. 6 is a bottom perspective view of the LED light engine with electrical components 120 mounted thereto.

FIG. 6 is a bottom perspective view of the LED light engine 102. The light engine 102 includes the leadframe 130 (shown in FIG. 3), the dielectric 118, the components 120 and the power contacts 116. The electrical components 120 are mounted to the mounting pads 148 of the conductors 132. The power contacts 116 are mounted to the corresponding mounting pads 148 of the conductors 132. The electrical components 120 and the power contacts 116 may be soldered directly to the conductors 132. Power is conveyed to the LED light engine 102 through the power contacts 116. The power is conveyed by the conductors 132 to the LED component 122. The other electrical components 120 affect the electrical circuits defined by the conductors 132 between the power contacts 116 and the LED component 122.

In the illustrated embodiment, the electrical components 120 include the LED component 122, a capacitor 190, a diode 192, a transient voltage suppressor diode (TVS) 194 and a resistor 196. Other electrical components 120 may be used in alternative embodiments. With reference back to FIGS. 3 and 4, in the illustrated embodiment, three conductors 132 are provided. The electrical components 120 may be mounted to various ones of the conductors 132. For example, a first of the conductors 132A may extend generally the entire length between the front and rear edges 140, 142 and cross from one side edge 144, at the front edge 140, to the other side edge 146, at the rear edge 142. The conductor 132A extends across the leadframe 130. The second and third conductors 132B, 132C are provided on opposite sides of the first conductor 132A. With additional reference to FIG. 6, the LED component 122 may be coupled to mounting pads 148 on the first and second conductors 132A, 132B. Similarly, the capacitor 190 and the diode 192 may be coupled to the first and second conductors 132A, 132B. The power contacts 116 may be coupled to the first and third conductors 132A, 132C. The TVS 194 and the resistor 196 may be coupled to the second and third conductors 132B, 132C. Other configurations are possible in alternative embodiments.

Figure 7:
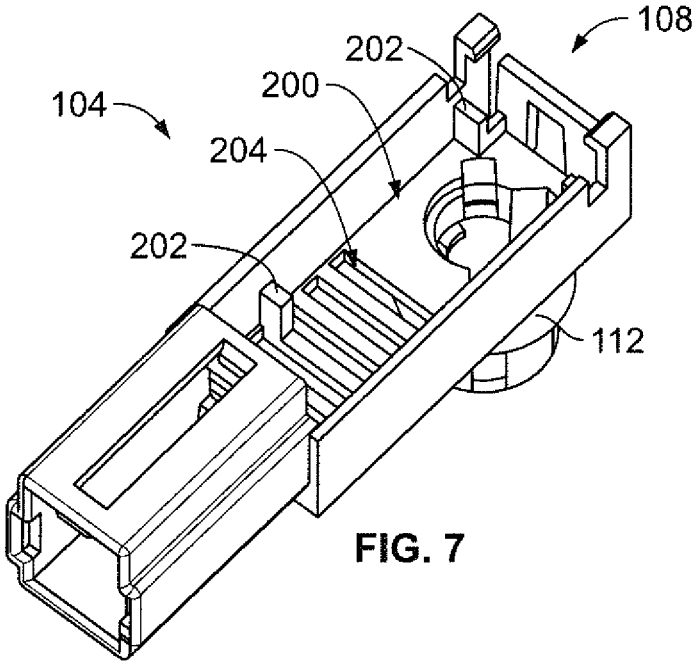
FIG. 7 illustrates a portion of a housing of the LED connector.

FIG. 7 illustrates a portion of the housing 104. The housing 104 includes a chamber 200 at the component end 108 that receives the LED light engine 102 (shown in FIG. 6). The housing 104 includes supports 202 extending into the chamber 200. The supports 202 hold the LED light engine 102 in position within the chamber 200. The housing 104 includes vents 204 that are open to the chamber 200 to allow air flow into the chamber 200. The light pipe coupler 112 is also open to the chamber 200 to receive light emitted from the LED light engine 102.

Figure 8:
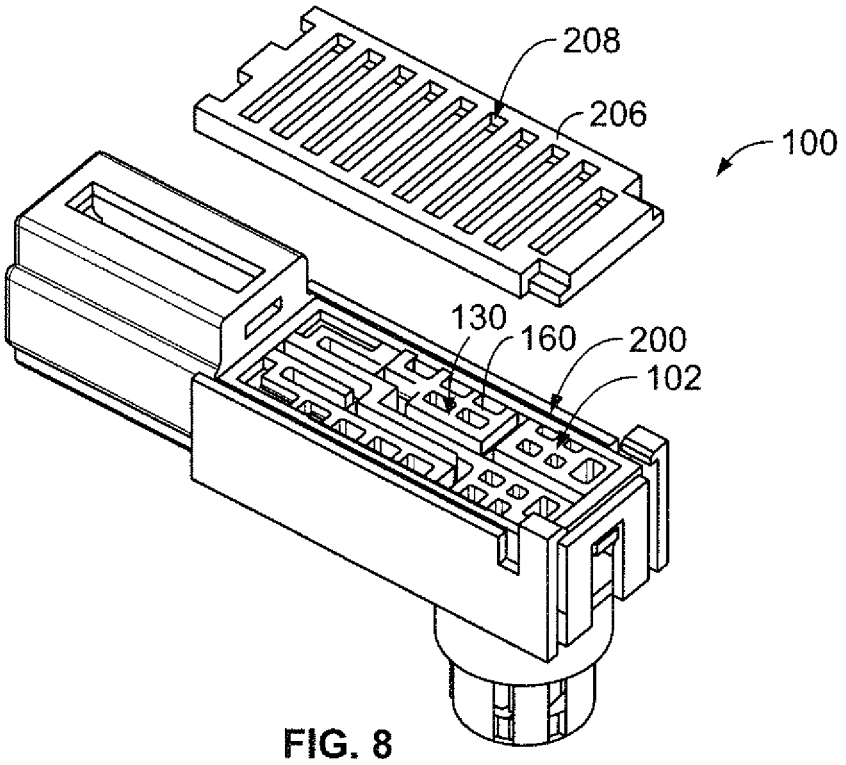
FIG. 8 illustrates the LED connector showing the LED light engine loaded into a chamber of the housing.

FIG. 8 illustrates the LED connector 100 showing the LED light engine 102 loaded into the chamber 200. A cover 206 is illustrated poised for closing the chamber 200. The cover 206 includes vents 208 that allow air flow into the chamber 200. The air flow through the vents 208 may pass over the heat dissipating fins 160 to dissipate heat from the leadframe 130.

Figure 9:
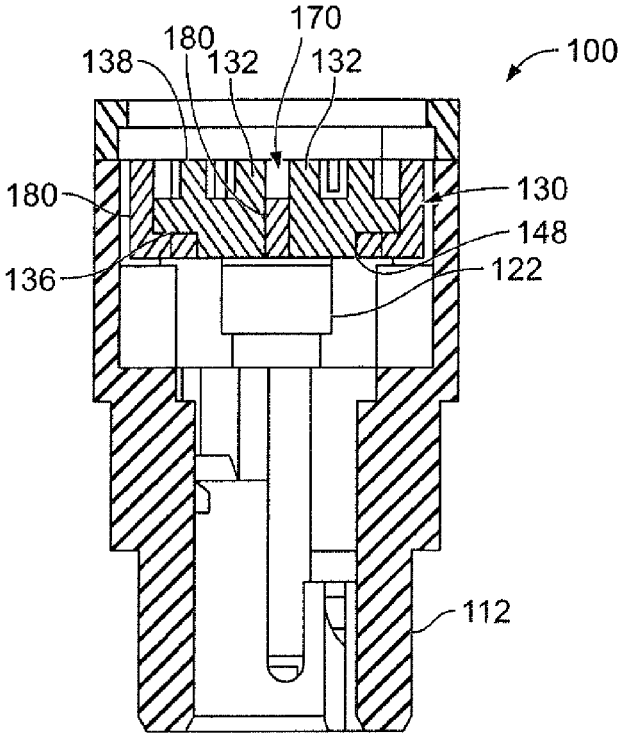
FIG. 9 is a cross-sectional view of the LED connector.

FIG. 9 is a cross-sectional view of the LED connector 100 taken through the LED component 122 and the light pipe coupler 112. The LED component 122 is shown directly coupled to the leadframe 130. The LED component 122 is mechanically and electrically coupled to the leadframe 130. The LED component 122 may be soldered directly to the mounting pads 148 on corresponding conductors 132. The conductors 132 are electrically separated from one another, using the gaps 170. The dielectric body 180 is illustrated within the gap 170. The dielectric body 180 is also illustrated covering the first side 136 but leaving the mounting pads 148 exposed. The heat dissipating fins 160 are exposed on the second side 138 to allow heat dissipating from the leadframe 130.

Figure 10:
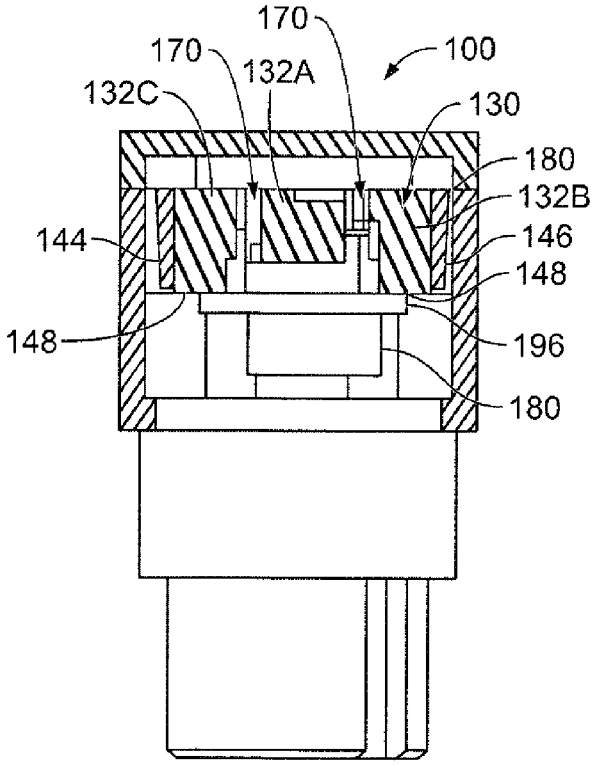
FIG. 10 is a cross-sectional view of the LED connector.

FIG. 10 is a cross-sectional view of the LED connector 100 taken through the resistor 196. The resistor 196 is directly coupled to the leadframe 130. The resistor 196 is mechanically and electrically coupled to corresponding conductors 132. For example, the resistor 196 may be soldered to corresponding mounting pads 148 of the second and third conductors 132B, 132C. The resistor 196 does not engage the first conductor 132A. The dielectric body 180 is illustrated within gaps 170 between the conductors 132A, 132B, 132C. The dielectric body 180 is illustrated along the edges 144, 146.

Figure 11:
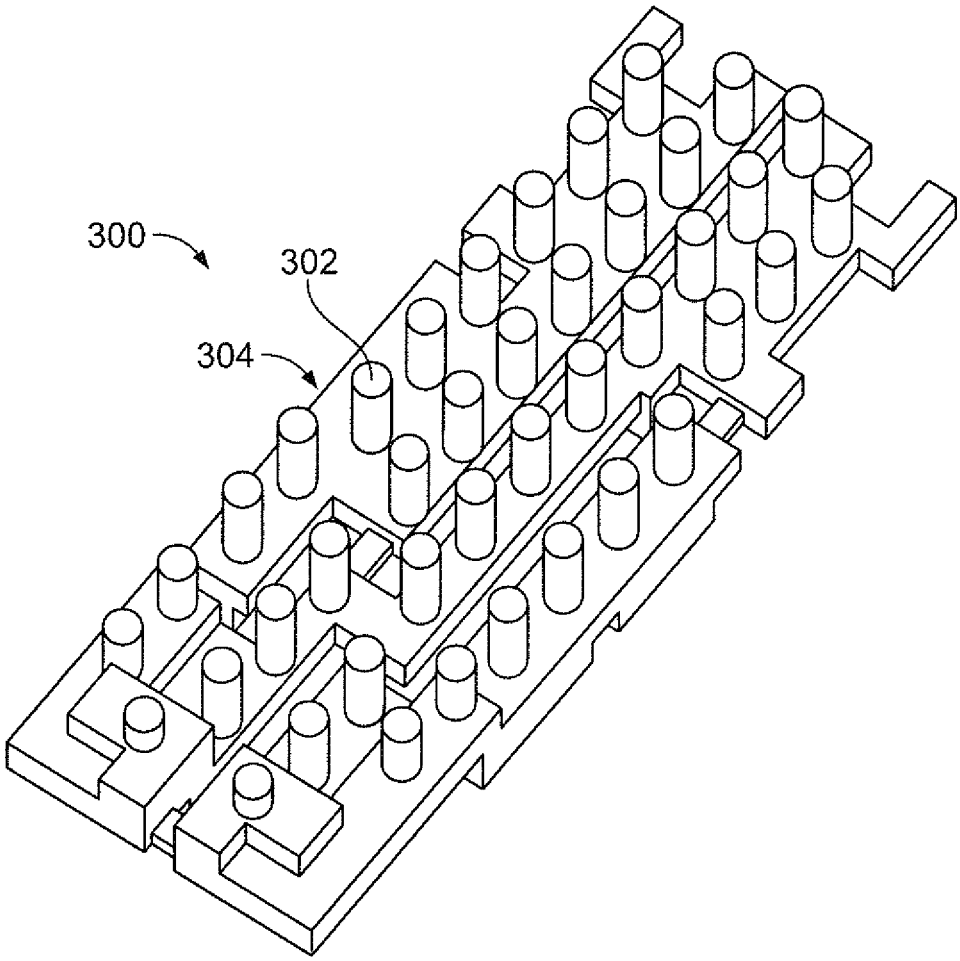
FIG. 11 is a top perspective view of a heat sink formed in accordance with an exemplary embodiment.

FIG. 11 is a top perspective view of a heat sink 300 formed in accordance with an exemplary embodiment. The heat sink 300 is similar to the heat sink 130 (shown in FIG. 4), however the heat sink 300 includes a plurality of heat dissipating fins 302 that are cylindrical in shape. The heat dissipating fins 302 are pin-shaped. The heat dissipating fins 302 have pockets 304 therebetween that allow air or other cooling fluid to flow therebetween to dissipate heat from the heat sink 300.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An LED connector comprising:

an LED component;

a molded heat sink comprising a plurality of conductors co-molded with each other, the conductors being formed from an electrically and thermally conductive material, the conductors having mounting pads, the LED component being mounted to the mounting pads, the conductors having heat dissipating fins exposed to cooling fluid;

wherein the conductors define both electrical circuits and thermal heat sinks for the LED connector without dissipating heat generated by the LED component through an interface to a printed circuit board.

2. The LED connector of claim 1, wherein the LED component is directly coupled to the mounting pads to create an electrical connection between the LED component and the conductors.

3. The LED connector of claim 1, further comprising an over molded dielectric body encasing portions of the conductors, the body being a dielectric material.

4. The LED connector of claim 1, wherein the conductors have power contacts extending therefrom defining a power connection for the LED connector, the conductors electrically connecting the power contacts and the LED component without routing the power through the printed circuit board.

5. The LED connector of claim 1, further comprising an over molded dielectric body encasing portions of the conductors, the mounting pads being exposed beyond the dielectric body, the heat dissipating fins being exposed beyond the dielectric body.

6. The LED connector of claim 1, wherein the heat sink has a first side and a second side, the mounting pads being arranged on the first side, the heat dissipating fins being arranged on the second side with air pockets between the heat dissipating fins to expose the heat dissipating fins to air.

7. The LED connector of claim 1, further comprising an over molded dielectric body encasing portions of the conductors, the body having windows exposing the conductors to air.

8. The LED connector of claim 1, wherein the conductors are separated by gaps, a dielectric body at least partially filling the gaps between the conductors.

9. The LED connector of claim 1, wherein the heat sink has a first side and a second side, the mounting pads being arranged on the first side, the conductors having inner surfaces extending between the first and second sides, the inner surfaces facing each other across gaps, the conductors having removable bridges spanning across the gaps and holding relative positions of the conductors, the LED connector further comprising a dielectric body at least partially filling the gaps, the dielectric body having windows exposing the bridges to allow for removal of the bridges to electrically separate the conductors.

10. The LED connector of claim 1, wherein the heat sink has a molded metal body extending between a first side and a second side, the mounting pads being arranged on the first side with the LED component mounted to the first side of the molded metal body of the heat sink, the conductors having inner surfaces formed during the molding of the molded metal body and extending entirely between the first and second sides, the heat dissipating fins being exposed to air, at the second side, for heat dissipation.

11. The LED connector of claim 1, further comprising a first electrical component, the first electrical component being mounted to corresponding mounting pads of the conductors, the conductors comprising a first conductor and a second conductor, wherein the first electrical component is directly coupled to the first and second conductors and wherein the LED component is directly coupled to the first and second conductors.

12. A LED connector comprising:

a heat sink having a first side and a second side, the heat sink comprising a plurality of discrete conductors separated by gaps, the conductors being formed from an electrically and thermally conductive material, the conductors having mounting pads at the first side, the conductors having fins at the second side that are exposed at the second side to air for heat dissipation, the conductors have inner surfaces extending between the first and second sides, the inner surfaces facing each other across the gaps, the conductors having removable bridges spanning across the gaps and holding relative positions of the conductors;

a dielectric body at least partially filling the gaps, the dielectric body having windows exposing the bridges to allow for removal of the bridges to electrically separate the conductors; and an LED component mechanically and electrically connected directly to the mounting pads of the heat sink, the conductors of the heat sink creating electrical circuits to power the LED component, the conductors defining direct thermal paths to dissipate heat from the LED component.

13. The LED connector of claim 12, further comprising an over molded dielectric body encasing portions of the conductors, the body at least partially filling the gaps between the conductors, the body being a dielectric material.

14. The LED connector of claim 12, further comprising an over molded dielectric body encasing portions of the conductors, the body having windows exposing the fins to air.

15. The LED connector of claim 12, wherein the heat sink has a single thermal interface between the LED component and the heat sink without dissipating heat generated by the LED connector through an interface to a printed circuit board.

16. A LED connector comprising:

a heat sink having a first side and a second side, the heat sink comprising a plurality of discrete conductors separated by gaps, the conductors being formed from an electrically and thermally conductive material, the conductors having mounting pads at the first side;

an over molded dielectric body molded over the heat sink, the body at least partially filling the gaps to hold the relative positions of the conductors; and an LED component mechanically and electrically connected directly to the mounting pads of the heat sink, the conductors creating electrical circuits to power the LED component, the conductors defining a primary heat sink for the LED component to dissipate heat from the LED component without dissipating heat generated by the LED connector through an interface to a printed circuit board.

17. The LED connector of claim 16, wherein the LED component is directly coupled to the mounting pads to create an electrical connection between the LED component and the conductors.

18. The LED connector of claim 16, wherein the conductors have heat dissipating fins on the second side, the heat dissipating fins being exposed to air at the second side.

19. The LED connector of claim 16, wherein the conductors have inner surfaces extending between the first and second sides, the inner surfaces facing each other across the gaps, the conductors having removable bridges spanning across the gaps and holding relative positions of the conductors, the dielectric body having windows exposing the bridges to allow for removal of the bridges to electrically separate the conductors.

* * * * *

UNITED STATES PATENT AND TRADEMARK OFFICE

CERTIFICATE OF CORRECTION

PATENT NO. : 9,239,135 B2
APPLICATION NO. : 13/557715
DATED : January 19, 2016
INVENTOR(S) : Kazuhiro Goto et al.

It is certified that error appears in the above-identified patent and that said Letters Patent is hereby corrected as shown below:

On the title page of this patent, in item 75 delete "Kazukiro" and replace with Kazuhiro Signed and Sealed this
Third Day of May, 2016

Michelle K. Lee

Michelle K. Lee
*Director of the United States Patent and Trademark Office*